United States Patent [19]

Buettel

[11] 4,290,834

[45] Sep. 22, 1981

[54] WEB SPLICING METHOD

[76] Inventor: Paul M. Buettel, 86 Longfellow Dr., Colonia, N.J. 07067

[21] Appl. No.: 155,309

[22] Filed: Jun. 2, 1980

Related U.S. Application Data

[63] Continuation of Ser. No. 43,899, May 30, 1979, abandoned, which is a continuation of Ser. No. 871,441, Jan. 23, 1978, abandoned.

[51] Int. Cl.[3] ..... B65H 19/18

[52] U.S. Cl. ..... 156/157; 156/504; 156/505; 242/58.2; 242/58.4; 242/58.6

[58] Field of Search ..... 156/157, 159, 504, 505; 242/58.2, 58.4, 58.3, 58.6, 59

[56] References Cited

U.S. PATENT DOCUMENTS

| | | | |
|---|---|---|---|
| 2,320,656 | 6/1943 | Roesen | 156/157 |
| 2,320,657 | 6/1943 | Roesen | 156/157 |
| 3,106,360 | 10/1963 | Kohler | 242/58.3 |
| 3,314,626 | 4/1967 | Hemphill | 242/58.2 |
| 3,520,748 | 7/1970 | Riegger | 156/159 |
| 3,547,739 | 12/1970 | Beute | 156/504 |
| 3,567,534 | 3/1971 | Kushiro | 156/157 |

*Primary Examiner*—Jerome W. Massie
*Attorney, Agent, or Firm*—Robert A. Green

[57] ABSTRACT

The invention includes a first running web roll and a second new web roll to be attached to the first web roll as it is running, and means for pressing the second roll against the running first web whereby the second roll is caused to be rotated and brought up to the same speed of rotation as the first roll. The second roll includes a leading end, which is to be attached to the running first web, and which carries strips of double-sided adhesive tape which do not adhere to the first web until, at a desired time, means are operated to press the running first web against the second web. At this time, the tape secures both webs together, and the second web begins to run with the first.

2 Claims, 6 Drawing Figures

Fig. 2
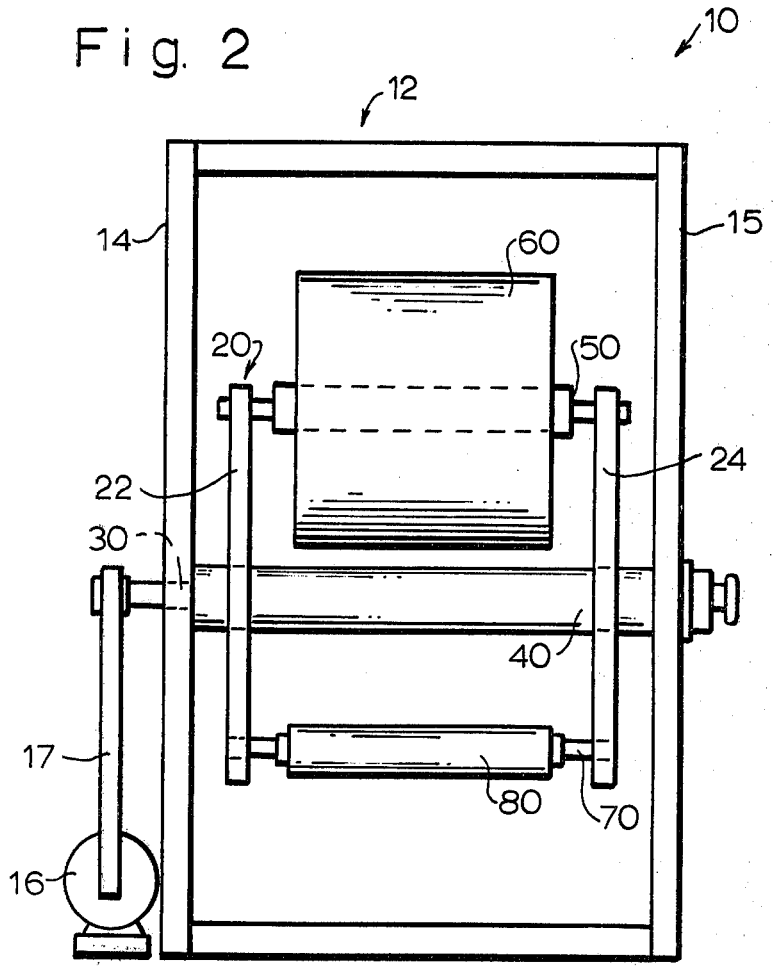
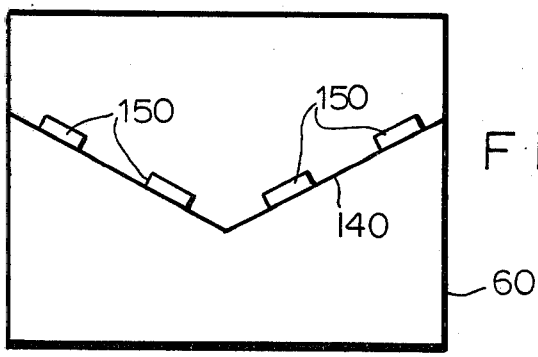
Fig. 3

Fig. 4
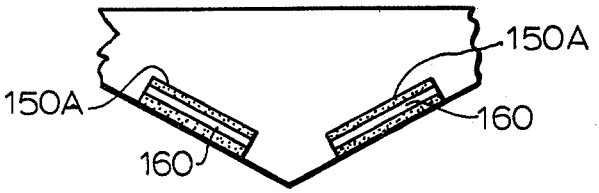
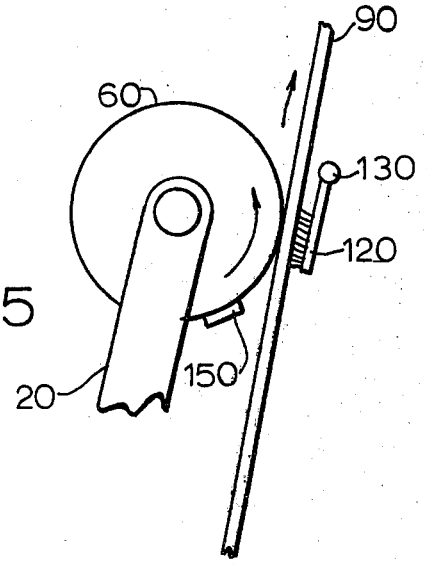
Fig. 5
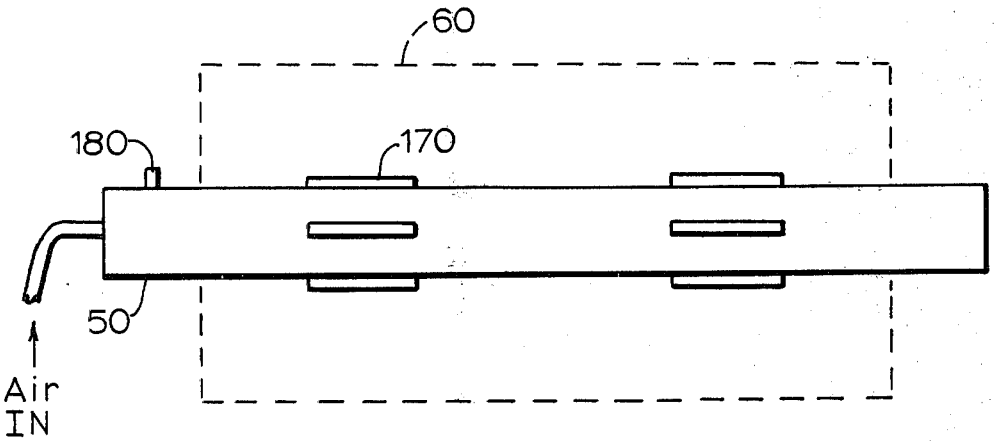
Fig. 6

WEB SPLICING METHOD

This is a continuation, of application Ser. No. 43,899, filed May 30, 1979 now abandoned; which is a continuation of application Ser. No. 871,441 filed Jan. 23, 1978 now abandoned.

BACKGROUND OF THE INVENTION

Many types of apparatus are known for attaching a new web roll to another which is expiring. Such known apparatus includes relatively complex arrangements for synchronizing the speed of the new roll with the old roll; and, in addition, in the prior art, precautions had to be taken to prevent the new web from wrinkling or tearing at the moment of coupling of the two rolls.

One prior art U.S. Pat. No. is 3,198,452, which shows splicing apparatus which uses adhesive tape on the new roll and a pressure brush for effecting the splice. However, this apparatus requires a separate drive means for bringing the new roll up to speed before the splice is made.

The present invention provides improved means for bringing one roll up to the speed of another rotating roll, and for attaching the end of the new roll to the running old web.

DESCRIPTION OF THE DRAWINGS

FIG. 2 is a front elevational view of some of the apparatus of FIG. 1;

FIG. 3 is a plan view of a new web roll and the leading edge thereof;

FIG. 4 is a plan view of a modification of the web roll shown in FIG. 3;

FIG. 5 is a side elevational view of a portion of the apparatus of FIG. 1 illustrating the operation thereof; and FIG. 6 is a side elevational view of apparatus for securing web rolls in place.

DESCRIPTION OF THE PREFERRED EMBODIMENTS

Figure 1:
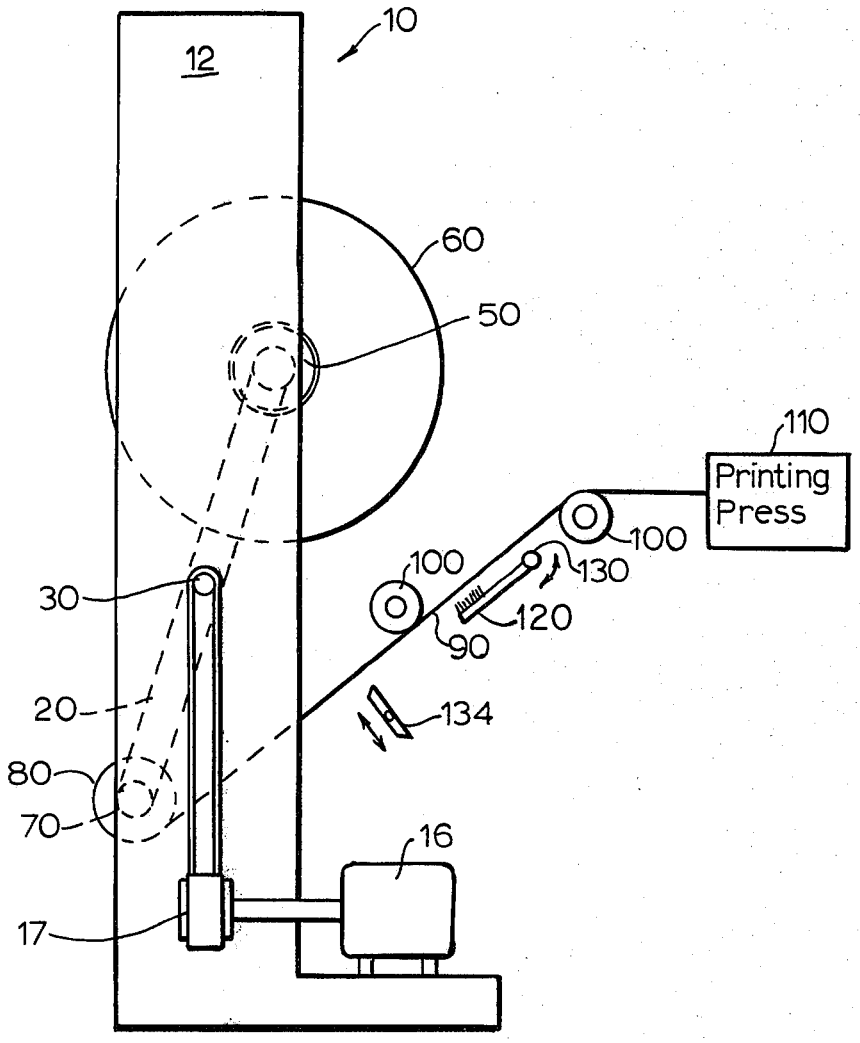
FIG. 1 is a side elevational view of the invention.

The apparatus of the invention 10 includes a main frame 12 made up of a pair of parallel frame uprights 14 and 15, between which is pivotally mounted a reel-mounting frame or cradle 20. The cradle 20 comprises a pair of spaced-apart arms 22 and 24; in which are journalled two reel shafts, upper shaft 50 and lower shaft 70, on which web rolls may be supported for rotation about parallel transverse axes. Upper shaft 50 carries a new web roll 60, and lower shaft 70 carries an old or expiring web roll 80. The old web 90 runs from its roll 80 over suitable guide rolls 100 to a printing press or other utilization apparatus 110 which includes drive means for pulling the old web to it.

Cradle or frame 20 is pivoted about its center 30 on a cradle shaft 40 for rotation about an axis which is parallel to, an equidistant from, the axes of shafts 50 and 70, and all of these shafts or axes lie in a common plane. Turning movement of the cradle 20 is effected by a motor 16 and suitable drive gear 17.

The rotation or turning of cradle 20 enables interchange of the positions of the reel shafts 50 and 70 so that the position of the upper net web roll 60 and the lower expiring roll 80 can be interchanged.

A brush 120, shown schematically, is positioned adjacent to the outer surface of the old web 90 for pivoting about point 130 whereby it can be pressed into engagement with the web 90 to apply pressure thereto for a purpose to be described. The brush 120 is preferably as wide as the web 90.

A cutting blade 140 is suitably mounted on main frame 12 for operation at a desired time to cut the old web after the new web has been attached.

FIG. 3 shows the leading edge 140 of the new web roll 60 as it appears when prepared for coupling to the expiring web. The edge may be straight, but is preferably cut in the manner illustrated to present a pointed leading edge and to provide greater contact area across the new web for the webs to be joined together. A plurality of strips 150 of commercially available, pressure-sensitive adhesive tape, having differential pressure-adhering characteristics, are provided on the outer surface of the web roll near the leading edge thereof. The nature of the invention is such that the number and location of such strips is not particularly critical. Of course, the new web roll is oriented so that, when it is attached to the old web, it will unroll in the proper direction.

In a preferred adhesive strip 150A illustrated in FIG. 4, a non-adhesive strip 160 is provided along the central portion of the adhesive exposed surface of the tape to provide two adhesive strip portions on either side thereof. This arrangement permits the strips to be provided along the very edge of the leading edge of the new web.

According to the method of the invention illustrated in FIG. 5, when it is desired to couple the new web to the old web, the cradle 20 is pivoted so that the new roll 60 is brought into engagement with the running old web 90, and the frictional engagement of the two rolls causes the new roll to rotate in the same direction as the old web (counterclockwise in FIG. 5), and, after a period of time, the new roll rotates at the same surface or linear space as the old web; that is, the contacting surfaces move at the same speed. However, even though the two webs are in contact and the old web is in contact with the strips 150 of double-sided tape as the new roll rotates with the old web, the two webs do not stick together. At the desired moment, when the new web is to be attached to the old, the brush 120 is brought into contact with the running web and the new roll behind it and applies pressure so that the two webs now adhere to each other at the adhesive strips. Thereafter, the old web is cut by operation of blade 134, and the new web proceeds to the printing press or other utilization device 110.

Other desirable novel apparatus is usable with the shafts 50 and 70 which carry the web rolls. Referring to FIG. 6 which shows shaft 50, the shaft carries a plurality of movable wedge members 170 disposed along its length for gripping and releasing the web roll. The wedges can be made to protrude a suitable distance above the surface of the shaft, to grip and hold roll 60 securely, by means of air pressure which can be introduced into the center of the shaft from an end thereof. When the air is removed, the wedges are released and retracted, and they release their holding grip on the roll 60. One novel feature of the shaft 50 comprises the provision of an air release valve 180 placed in the outer surface of the shaft intermediate its ends and adjacent to the roll 60 where it is readily accessible to an operator. The valve 180 may be of the type used in automobile tires, and it can be readily operated when desired to remove air from the shaft and release the wedges 170 to permit the roll to be removed from the shaft or to permit a new roll to be mounted and secured on the shaft.

What is claimed is:

1. The method of splicing a new web to an old web comprising the steps of transporting a first running web which is free of adhesive means adjacent the trailing edge portion from a first web roll to a printing press at a selected speed, applying strips of double-sided, pressure-sensitive adhesive tape, having differential pressure-adhering characteristics, to the leading edge of a second web of a second new web roll, bringing said second new web roll into contact with said first web, with said first web making contact with, but not adhering to, said strips of double-sided, pressure-sensitive adhesive tape, whereby said second web roll is caused to rotate at such a velocity that the line of contact of the second web roll with the first web is moving at the same speed as said first web, and applying pressure to said running first web and said rotating second web roll at a preselected time to cause the web of the second web roll to adhere to the double-sided, pressure-sensitive adhesive tape and thus to the first web whereby said second web is transported to said printing press.

2. The method defined in claim 1 and including the step of providing each said strip of adhesive tape with a strip of non-adhesive material to form each adhesive strip into two spaced-apart adhesive strip portions.

* * * * *